US006390407B1

(12) United States Patent
Kudrus

(10) Patent No.: US 6,390,407 B1
(45) **Date of Patent: *May 21, 2002**

(54) WINDING MACHINE FOR CONTINUOUSLY RUNNING YARN HAVING IMPROVED COOLING FEATURES

(75) Inventor: Heiner Kudrus, Barmstedt (DE)

(73) Assignee: Neumag-Neumuenstersche Maschinen-und Anlagenbau GmbH, Neumuenster (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/667,265

(22) Filed: Sep. 22, 2000

(30) Foreign Application Priority Data

Sep. 24, 1999 (DE) ..... 199 45 823

(51) Int. Cl.[7] ..... B65H 54/00; B65H 67/048; H05K 7/20

(52) U.S. Cl. ..... 242/474.5; 242/470; 361/695

(58) Field of Search ..... 242/470, 474.5, 242/474.6; 361/688–723

(56) References Cited

U.S. PATENT DOCUMENTS

| | | | | |
|---|---|---|---|---|
| 4,487,374 A | * | 12/1984 | Sugioka et al. | 242/474.5 |
| 5,234,173 A | * | 8/1993 | Nishikawa et al. | 242/474.5 |
| 5,566,904 A | * | 10/1996 | Hashimoto | 242/474.5 |
| 5,605,294 A | * | 2/1997 | Migaki et al. | 242/474.6 |
| 5,794,868 A | * | 8/1998 | Busenhart et al. | 242/470 |
| 5,927,636 A | * | 7/1999 | Rafflenbeul | 242/470 |
| 5,954,258 A | * | 9/1999 | Baader et al. | 361/695 X |
| 6,286,778 B1 | * | 9/2001 | Kudrus | 242/474.5 X |

FOREIGN PATENT DOCUMENTS

| | | |
|---|---|---|
| DE | 41 28 803 A1 | 3/1992 |
| DE | 195 11 114 C1 | 8/1996 |
| EP | 0 771 302 B1 | 6/1998 |
| EP | 0 845 432 A1 | 6/1998 |
| EP | 0 770 030 B1 | 10/1998 |
| JP | 6-247627 | 9/1994 |
| JP | 10194591 A | 7/1998 |

* cited by examiner

*Primary Examiner*—Michael R. Mansen
(74) *Attorney, Agent, or Firm*—Michael J. Striker

(57) ABSTRACT

The winding machine for a continuously running yarn includes a machine housing (1), a supporting arm (12) projecting from an upper part of the machine housing; two bobbin spindles (6,7) for respective bobbins sleeves (8,9); traversing units for the bobbin spindles in the supporting arm (12); a contacting roller (13); drive motors for the bobbins spindles, the contacting roller (13) and the traversing units (14) and an electronic device including an inverter for supplying the drive motors with electrical energy. The electronic device, the supporting arm, the contacting roller and the bobbins spindles are all on the same side of the machine housing. In order to provide improved cooling the flat control housing (19) for the electronic unit is separately mounted below the supporting arm (12) near the feet (2,3) of the winding machine and has the cooling ribs (20) facing the bobbins so that an air flow is produced over the cooling ribs during operation because of motion of the bobbins.

8 Claims, 2 Drawing Sheets

FIG.3
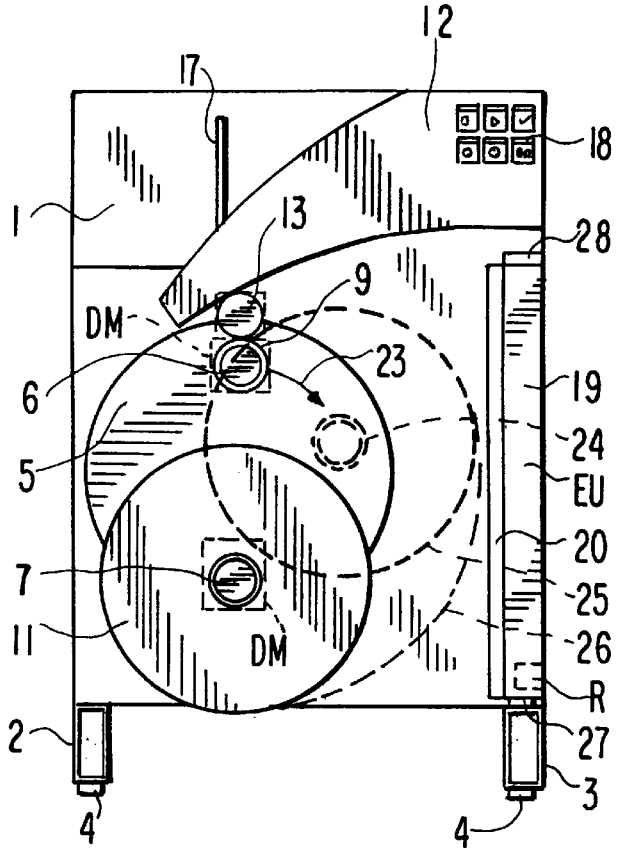
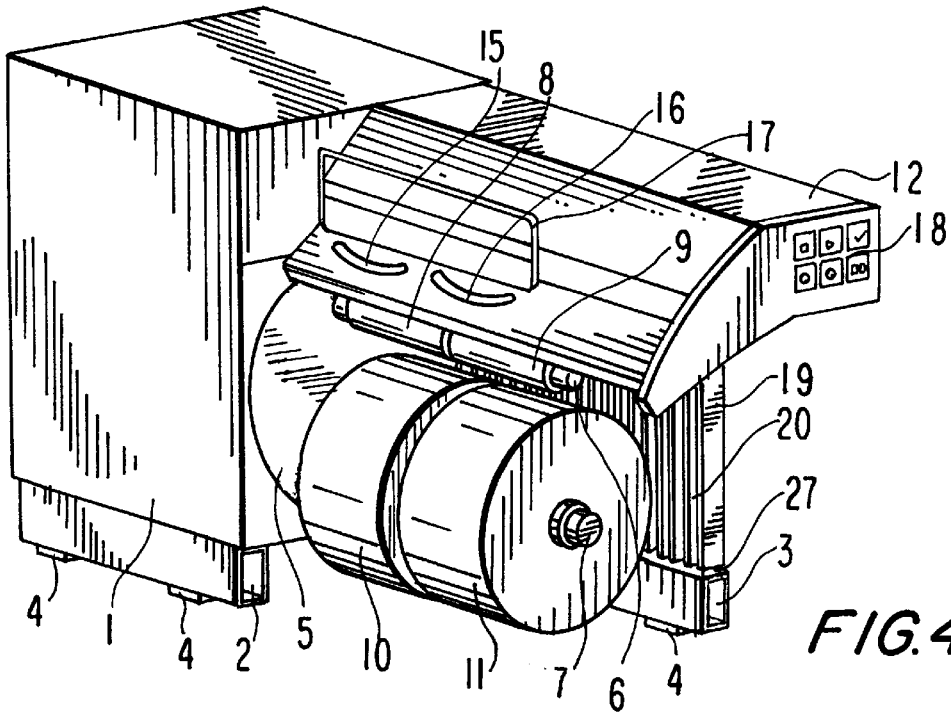
FIG.4

WINDING MACHINE FOR CONTINUOUSLY RUNNING YARN HAVING IMPROVED COOLING FEATURES

BACKGROUND OF THE INVENTION

The present invention relates to a winding machine for continuously running yarn or thread, and, more particularly, to a winding machine for continuously running yarn or thread comprising two bobbin spindles, which are mounted on a rotatable spindle below a projecting supporting arm extending from a machine housing and which can be alternately positioned between a winding position and a waiting position. Each spindle can support several bobbin sleeves. Several traversing units are arranged next to each other in the supporting arm.

This sort of winding machine for continuously running thread or yarn is described in EP 0 845 432 A1. An especially advantageous feature of this prior art machine is that the electronic unit or controller is not arranged, as usual in the prior art, in a separate control unit or panel behind the winding machine, but instead in the supporting arm which is arranged on the winding machine itself. The supporting arm has a U-shape in this machine, with its U-cross-section open upwardly, and the electronic unit is arranged between the upwardly extending sides of the supporting arm. It is provided with a cover and cooling ribs are provided on the topside of the cover. Because of the cooling ribs heat generated in the inverter, which in operation provides the energy for the drive, is dissipated. However generation of airflow over the cooling ribs or bodies is recommended to provide needed cooling during operation.

SUMMARY OF THE INVENTION

It is an object of the present invention to provide an improved winding machine for continuously running yarn or thread, in which the cooling is improved in a special way without additional costs or efforts.

According to the invention the winding machine for continuously running yarn or thread, comprises a machine housing;

a supporting arm projecting from an upper portion of the machine housing, said supporting arm comprising at least one traversing unit;

a contacting roller;

at least one bobbin spindle for holding at least one bobbin sleeve, according to a total number of the traversing units present;

drive motors for the at least one bobbin spindle, the contacting roller and the at least one traversing unit; and an electronic unit comprising an inverter for supplying the drive motors with electrical energy and means for controlling the drive motors;

wherein the electronic unit is arranged on the same side of the machine housing as the supporting arm, the contacting roller and the at least one bobbin sleeve; and the electronic unit is arranged below the supporting arm.

The winding machine according to the invention has a structure that enables the required airflow for cooling the electronic unit or device to be supplied during operation by the rapidly rotating bobbins.

Various preferred embodiments provide additional advantages.

In a preferred embodiment the electronic unit is accommodated in a flat control housing having a side facing the bobbin spindle or spindles and the control housing is provided with cooling ribs on a side facing the spindle or spindles. In an especially preferred embodiment the control housing accommodating the electronic unit is flat and arranged in the vicinity of supporting members or feet of the winding machine and cooling ribs are oriented transversely to an axis of the contacting roller. In another especially preferred embodiment the control housing accommodating the electronic unit is flat, rests on one of its small edges and extends on a long side of the winding machine and the cooling ribs are vertically oriented. In both especially preferred embodiments the control housing is spaced from the bobbin spindles or bobbins with the cooling ribs facing them, so that a sufficient airflow for cooling is provided during operation.

BRIEF DESCRIPTION OF THE DRAWING

The objects, features and advantages of the invention will now be illustrated in more detail with the aid of the following description of the preferred embodiments, with reference to the accompanying figures in which:

FIG. 3 is a schematic front view of a second embodiment of a winding machine according to the invention; and FIG. 4 is a perspective view of the winding machine shown in FIG. 3.

DESCRIPTION OF THE PREFERRED EMBODIMENTS

Figure 1:
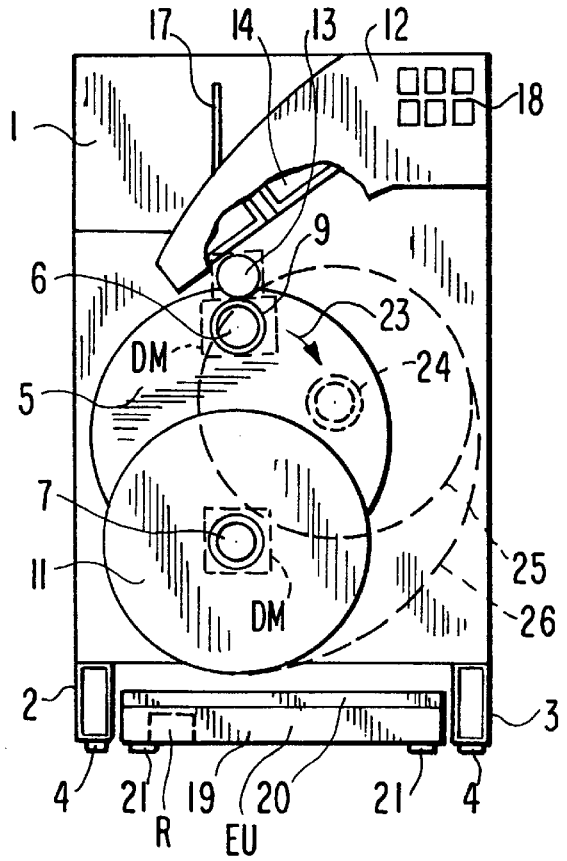
FIG. 1 is a schematic partially cutaway, front view of a first embodiment of a winding machine according to the invention.
Figure 2:
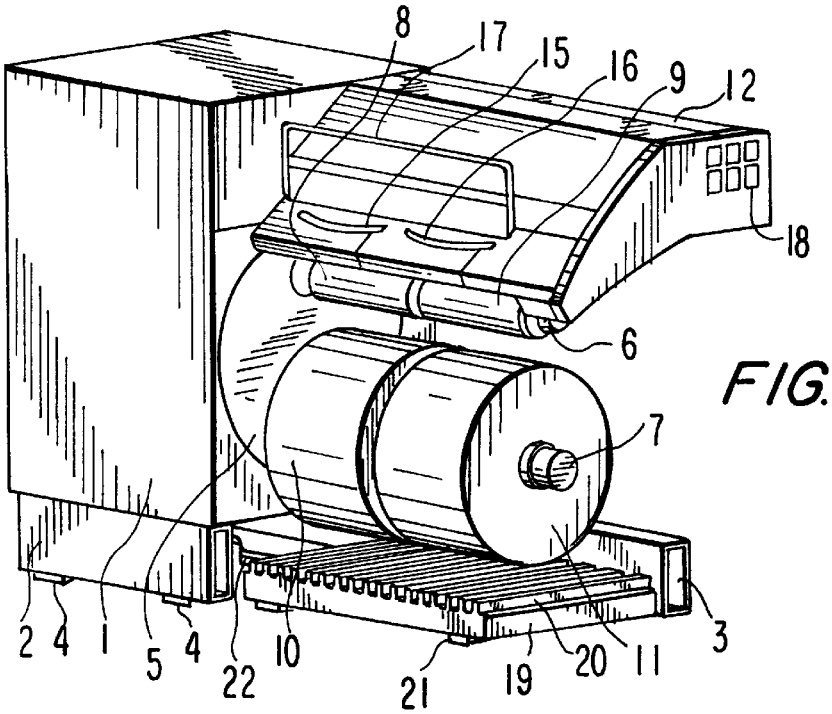
FIG. 2 is a perspective view of the winding machine shown in FIG. 1.

A machine housing 1 rests on two stand or supporting members 2,3 in the form of horizontal pipes each having a rectangular cross-section, which are connected with the lateral edge regions of a base of the machine housing and are provided with damping elements 4 on their bottom ends. A disk-like bobbin support 5 is rotatably mounted so as to be rotatable about a horizontal axis. Two projecting spindles 6,7 are mounted on opposite sides of the bobbin support, spaced about 180° from each other. Two axially aligned empty spindle sleeves 8,9 are supported on the spindle 6, which is shown above the other spindle 7 in the drawing. Two finished wound bobbins 10, 11 sit on the other spindle 7, already ready for removal and transport.

A projecting supporting arm 12, whose cross-section extends almost over the entire width of the machine housing 1, is attached to the machine housing 1 above the bobbin support 5. A contacting roller 13, which extends parallel to the spindles 6,7 substantially over their entire length, is mounted in the vicinity of a longitudinal edge of the supporting arm. Respective traversing units 14 associated with the individual spindle sleeves 8,9 are accommodated in the supporting arm 12 above the contacting roller 13. Each traversing unit 14 is equipped with two rotors driven in opposite rotational directions, which each have two or three propeller-like vanes or blades. These traversing units, the so-called blade traversers, are described in EP 0 771 302 B1. Respective curved slots 15, 16 are provided above the individual traversing units 14 in a cover of the supporting arm 12 for each of the corresponding yarns or threads. The cover is provided with a common guiding bracket 17, which extends over an entire length of the spindles 6,7. An operator's panel 18 is provided on the free end of the supporting arm 12, which provides controls for the operating personnel for control of the machine.

The spindles 6,7, the contacting rollers 13 and the traversing units 14 are provided with drive motors DM, which are shown only diagrammatically in the drawing. The different drive motors DM are coupled with each other in a known manner. A flat box-shaped control housing 19 is arranged at a short distance under the region described in more detail hereinbelow, which is reserved for the bobbin structure and for the motion of the bobbins according to the rotational motion of the spindle support 5. It essentially fills the entire free area between both stand members 2,3, which extends approximately over the length of the spindles 6,7 (that is also true for the stand member 2 which is shown cutaway in the drawing to improve the clarity of the illustration). The height of the controller housing 19 is small in comparison to its dimensions in the transverse and longitudinal direction, so that it has approximately the form of a plate. Its upper side is provided with cooling ribs 20, which extend transversely. Damping elements 21 are provided on its lower side. It is supported on the ground independently of the machine housing 1. An electronic unit or device EU, which especially includes an inverter R for supplying the drive motors with electrical energy, is accommodated in the interior of the controller housing 19. The electronic unit or device EU in the controller housing 19 also includes electronic means for control of machine operation and for signal transmission. The electronic device EU unit is connected with the drive motors, with the operator's panel 18, with unshown sensors and with an external control system by means of a plug strip and by means of an unshown cable.

In operation, bobbins are wound on the spindle sleeves 8,9, which sit on the spindle 6 in a winding position. Accordingly the bobbin support 5 is rotated—as already described for example in EP 770 030 B1—in the direction of the arrow 23 according to the increasing diameter of the bobbins, so that the bobbins in the structure are continuously under a gentle pressure from the spatially fixed contacting roller 13. If the spindle 6 is in the position 24 shown with dashed lines, the new bobbin 25 has reached the predetermined diameter. The bobbin or spindle support 5 now quickly rotates further, until the spindle 7, which in the meantime is provided with a fresh spindle sleeve after withdrawal of the finished bobbins 11,12, arrives at the contacting roller 13 in the position in which the spindle 6 is shown in FIG. 1. During this rotation the bobbin 25 passes through a spatial region which extends up to a sleeve surface 26.

A powerful airflow is produced by the rotating bobbins present in the structure which rotate at a high rotation speed, for example 2000 m/sec, which sweeps or brushes over the top side of the controller housing 19 provided with the cooling ribs 20 in the direction in which the cooling ribs 20 extend. Because of this feature the heat, which is produced by the electronic components, especially by the inverter for the drive motor, is effectively dissipated. A failure of the cooling during the winding operation is thus prevented. Because of the independent mounting of the controller housing 19 vibrations of the machine are not transferred or transmitted to the control housing and the electronic components in it. The damping elements 4,21 prevent the indirect transfer of vibrations from the machine to the electronic components through the floor.

The embodiment illustrated in FIGS. 3 and 4 differs from the above-described embodiment, because the control housing 19 is arranged beside the spatial region, which is reserved for the bobbin structure and the motion of the bobbins according to the rotation of the spindle support 5. The control housing of course extends on the long side of the spindles which is opposite to the long side on which the contacting roller 13 contacts. The control housing 19 stands on its small or narrow edge on the stand member 3 and extends upward until its upper edge nearly reaches the supporting arm 12. Damping elements 27,28 are arranged between the control housing 19 and the stand member 3 and/or the supporting arm 12. The ribs 20 are formed on the side, which is facing the sleeve surfaces 26, and extend vertically. The spacing of the ribs 20 from the sleeve surfaces 26 is large enough so that the full bobbin 25 remains unhindered in its motion.

The operation of the second embodiment is similar to that of the first embodiments and so further description of the operation is dispensed with.

The disclosure in German Patent Application 195 45 823.5-26 of Sep. 24, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a winding machine for continuously running yarn, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A winding machine for continuously running yarn, said winding machine comprising a machine housing (1);

a supporting arm (12) projecting from an upper portion of the machine housing, said supporting arm (12) comprising at least one traversing unit (14);

a contacting roller (13);

at least one bobbin spindle (6,7) for holding at least one bobbin sleeve (8,9), according to a total number of said at least one traversing unit;

drive motors (DM) for said at least one bobbin spindle, said contacting roller and said at least one traversing unit; and an electronic unit (EU) comprising an inverter (R) for supplying the drive motors with electrical energy;

wherein said electronic unit (EU) is arranged on a side of the machine housing on which the supporting arm, the contacting roller and the at least one bobbin sleeve are also arranged; and wherein said electronic unit is arranged under the supporting arm (12).

2. The winding machine as defined in claim 1, wherein said electronic unit (EU) is accommodated in a control housing (19).

3. The winding machine as defined in claim 2, wherein said control housing (19) has a side facing said at least one bobbin spindle (6,7) and said control housing (19) is provided with cooling ribs (20) on said side of said control housing (19) facing said at least one bobbin spindle (6,7).

4. The winding machine as defined in claim 3, further comprising stand member (2,3) and wherein the control housing (19) accommodating the electronic unit (EU) is flat and arranged in the vicinity of said stand members and the cooling ribs (20) are oriented transversely to an axis of the contacting roller (13).

5. The winding machine as defined in claim 3, having a long side and wherein the control housing (19) accommodating the electronic unit is flat and has an edge, said control housing rests on said edge and extends on said long side and the cooling ribs (20) are vertically oriented.

6. A winding machine for a continuously running yarn, said winding machine comprising a machine housing (1), a supporting arm (12) projecting from an upper part of the machine housing; two bobbin spindles (6,7) for respective bobbins sleeves (8,9); traversing units (14) arranged in the supporting arm (12); a contacting roller (13); an electronic device (EU) for supplying and controlling electrical energy for driving the bobbin spindles, the traversing units and the contacting roller (13); and a flat control housing (19) accommodating said electronic device (EU) and having a plurality of cooling ribs (20);

wherein the electronic device, the supporting arm, the contacting roller and the bobbins spindles are arranged on one and the same side of the machine housing; and wherein the flat control housing (19) for the electronic unit is separately mounted below the supporting arm (12) in the vicinity of supporting members (2,3) for the machine housing and the flat control housing (19) is arranged so that the cooling ribs (20) face the bobbin spindles, whereby an air flow is produced over the cooling ribs (20) during operation because of bobbin motion that the electronic device with the inverter is sufficiently cooled during operation.

7. The winding machine as defined in claim 6, wherein said supporting arm (12) has an operator's control panel (18) and said control panel (18) is connected electrically with said electronic device in said flat control housing (19).

8. The winding machine as defined in claim 6, wherein said bobbin sleeves (6,7) are mounted on opposite sides of a rotatable bobbin support (5) supported in said machine housing.

* * * * *

UNITED STATES PATENT AND TRADEMARK OFFICE

CERTIFICATE OF CORRECTION

PATENT NO. : 6,390,407 B1
DATED : May 21, 2002
INVENTOR(S) : Kudrus

It is certified that error appears in the above-identified patent and that said Letters Patent is hereby corrected as shown below:

Title page,
Item [73], delete as Assignee "Neumag_Neumuensterche Maschinen-und Anlagenbau GmbH" and substitute -- Barmag AG --

Signed and Sealed this

Eighth Day of April, 2003

JAMES E. ROGAN
*Director of the United States Patent and Trademark Office*